US006422039B2

(12) United States Patent
Bamminger et al.

(10) Patent No.: US 6,422,039 B2
(45) Date of Patent: Jul. 23, 2002

(54) GEM

(75) Inventors: Wolfgang Bamminger, Schwaz; Herbert Öfner; Emil Reisigl, both of Wattens; Harald Weingärtner, Sautens; Michael Winter, Schwaz, all of (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 09/732,730

(22) Filed: Dec. 11, 2000

(30) Foreign Application Priority Data

Jul. 20, 2000 (AT) ..... 1276/2000

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | | |
|---|---|---|---|---|---|
| 693,084 | A | * | 2/1902 | Townsend | 63/32 |
| 3,585,764 | A | * | 6/1971 | Huisman | 451/58 |
| 4,306,427 | A | * | 12/1981 | Urban | 63/32 |
| D330,344 | S | * | 10/1992 | Hedgecock | D11/90 |
| 5,462,474 | A | * | 10/1995 | Hansen | 451/41 |
| D382,225 | S | * | 8/1997 | Yuan | D11/90 |
| D382,506 | S | * | 8/1997 | Cohen | D11/90 |
| D415,712 | S | * | 10/1999 | Tolkowsky | D11/90 |
| 5,970,744 | A | * | 10/1999 | Greeff | 63/32 |
| 6,006,548 | A | * | 12/1999 | Freilich | 63/32 |
| D434,341 | S | * | 11/2000 | Kavalek | D11/90 |
| D434,691 | S | * | 12/2000 | Swarovski | D11/90 |
| D439,864 | S | * | 4/2001 | Cohen | D11/90 |
| D442,114 | S | * | 5/2001 | Greeff | D11/90 |

OTHER PUBLICATIONS

He Ming Cheng, Hong Kong Design Application No. 98319538.2 (Enclosure A), Mar. 1999.
German Design No. 499 08 4355 (Enclosure B), Feb. 2000.
Czech Design No. 28710 (version 6.1) (Enclosure C), Jul. 1999.
Swarovski chaton 1200. (Enclosure D), Date Unknown.
Facett design 1.084 Carol's Cut published in Facett Design vol. 5, Rounds by Robert Long & Norman, Date Unknown.

* cited by examiner

*Primary Examiner*—J. J. Swann
*Assistant Examiner*—Andrea Chop
(74) *Attorney, Agent, or Firm*—Wenderoth, Lind & Ponack, L.L.P.

(57) ABSTRACT

A gemstone has a faceted crown which is inclined with respect to the main axis and which is defined on the one end by a preferably flat table and on the other hand by a peripheral edge of the gemstone. A faceted pavilion is inclined with respect to the main axis, adjoins the peripheral edge, and converges to a tip. The facets (3) of the crown (2) are all inclined at the same crown angle ($\beta$) with respect to the main axis (1), while the facets (7, 7') of the pavilion (6) are inclined at two different pavilion angles ($\alpha_1$, $\alpha_2$) with respect to the main axis (1). The first set of facets (7) of the pavilion (6) which are inclined at a first pavilion angle ($\alpha_1$) extend to the peripheral edge (5), and the second set of facets (7') of the pavilion (6) which are inclined at a second pavilion angle ($\alpha_2$) start from the tip (8) without reaching the peripheral edge (5).

8 Claims, 3 Drawing Sheets

GEM

BACKGROUND OF THE INVENTION

The invention concerns a gemstone having a faceted crown which is inclined with respect to the main axis and which is defined on the one hand by a preferably flat table and on the other hand by a peripheral edge of the gemstone. A faceted pavilion is inclined with respect to the main axis and adjoins the peripheral edge and converges to a tip.

In the case of artificial gemstones, in particular glass gemstones, there is from time to time an interest in achieving a reflection characteristic which radiates in as wide spread a fashion as possible, when there is central illumination on to the table.

SUMMARY OF THE INVENTION

In order to achieve that, the invention proposes that the facets of the crown are all inclined at the same crown angle with respect to the main axis while the facets of the pavilion are inclined at two different pavilion angles with respect to the main axis. The first set of facets of the pavilion are inclined at a first pavilion angle and extend to the peripheral edge, and the second set of facets of the pavilion are inclined at a second pavilion angle and start from the tip without reaching the peripheral edge.

The Applicants' measurements have shown that a widening of the reflection characteristics can be achieved by cutting a second pavilion angle, that is to say a second set of facets, which are inclined at a shallower angle with respect to the main axis. Upon central illumination in the direction of the main axis on to the table, therefore, relevant levels of radiation intensity are still to be expected even at relatively large angles with respect to the main axis.

It has proven to be particularly advantageous if the second set of facets of the pavilion which are inclined at the second pavilion angle, in a view from below directed on to the tip of the gemstone, extend radially over a distance of between 25% and 75% of the projected tip-peripheral edge spacing (grinding depth of the second layer of between 25% and 75%).

A further alternative configuration of the invention is characterized in that the facets of the crown are all inclined at the same crown angle with respect to the main axis while the facets of the pavilion are inclined at two different pavilion angles with respect to the main axis. The first set of facets of the pavilion are inclined at a first pavilion angle and extend to the peripheral edge, and the second set of facets of the pavilion are inclined at a second pavilion angle and start from the tip. The crown angle is between 40° and 44° (preferably about 42°), the first pavilion angle is between 40° and 44° (preferably about 42°), and the second pavilion angle is between 32° and 36° (preferably about 34°).

BRIEF DESCRIPTION OF THE DRAWINGS

Further advantages and details of the invention are described in greater detail with reference to the drawings, wherein:

FIGS. 6, 7 and 8 each show diagrammatic representations of the reflected light strength in dependence on the height angle theta with a constant angle phi=0, wherein FIG. 6 depicts a gemstone according to the state of the art as shown in FIGS. 1*a*, 1*b* and 1*c*, FIG. 7 depicts a gemstone according to the invention as shown in FIGS. 2*a*, 2*b* and 2*c*, and FIG. 8 depicts a gemstone according to the invention as shown in FIGS. 3*a*, 3*b* and 3*c*.

DETAILED DESCRIPTION OF THE INVENTION

The gems illustrated in the Figures are the type described as chaton.

Figure 1A:
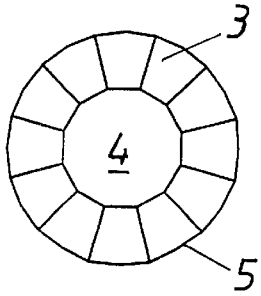
FIGS. 1*a*, 1*b* and 1*c* show a 12-facet gemstone (chaton) in accordance with the state of the art, which has a single-layer crown and a single-layer pavilion.
Figure 1B:
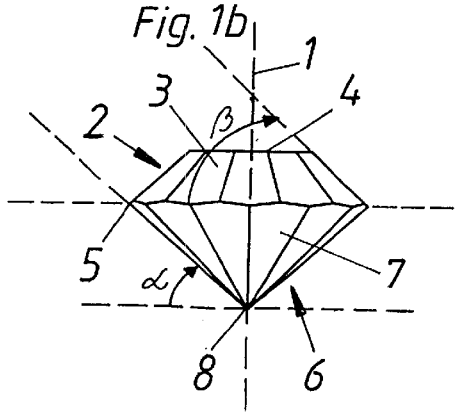
Figure 1C:
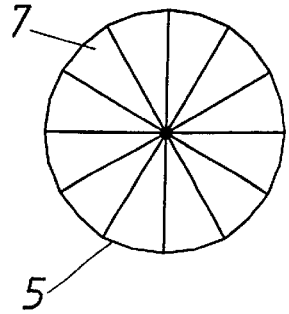

The 12-facet chaton shown in FIGS. 1*a*, 1*b* and is has a crown 2 with twelve facets 3. Each facet 3 is inclined with respect to the main axis 1, and is delimited by a flat table 4. Adjoining the peripheral edge 5 (which can also be in the form of a girdle beveled parallel to the main axis 1) is the pavilion 6 which also has twelve facets 7 which converge to a tip 8. The crown angle is denoted by P and the pavilion angle by $\alpha$.

Figure 6:
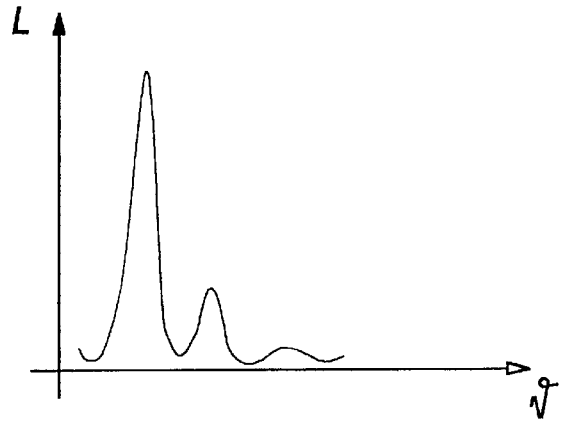

A 12-facet chaton gemstone as shown in FIGS. 1*a*, 1*b* and is gives, for a width angle phi 0 in dependence on the height angle theta, a reflection characteristic as is shown approximately in FIG. 6.

An increase in the width of that reflection characteristic (i.e., relevant levels of light intensity with greater angles theta) can be achieved if, in accordance with the invention, there is ground in from the tip 8 a second layer of facets with a second pavilion angle, as is shown in FIGS. 2*a*, 2*b*, 2*c* and 3*a*, 3*b* and 3*c*. The crown 2 of the gemstone according to the invention has the same configuration as in the state of the art (i.e., a single-layer configuration with a single crown angle R of the facets 3 with respect to the main axis 1).

Now, in accordance with the invention, on the pavilion 6, there are twelve facets 7 which are inclined at the pavilion angle ai with respect to the main axis 1 and extend between the peripheral edge and an intermediate edge between the peripheral edge and the tip of the gemstone. In addition there are twelve further facets 7' which are inclined at a second shallower pavilion angle $a_2$ with respect to the main axis 1 and which are ground in from the tip 8 but without reaching the peripheral edge 5. In other words, each of the second set of facets 7' extend between the tip and the intermediate edge.

In the embodiment shown in FIGS. 2*a*, 2*b* and 2*c*, the facets 7', in the view from below directed on to the tip 8 of the gemstone, as in FIG. 2*c*, extend radially outwardly over a distance of 50% of the projected tip-peripheral edge spacing. Reference is made here to a grinding depth of the second layer of 50%.

Figure 2A:
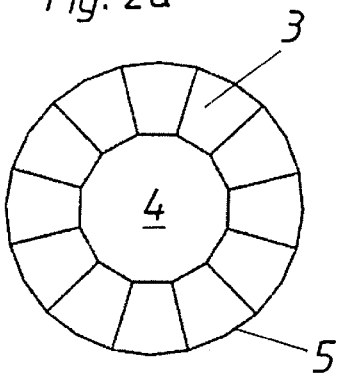
FIGS. 2*a*, 2*b* and 2*c* show an embodiment of a gemstone (chaton) according to the invention, having a second pavilion layer with a 50% grinding depth.
Figure 2B:
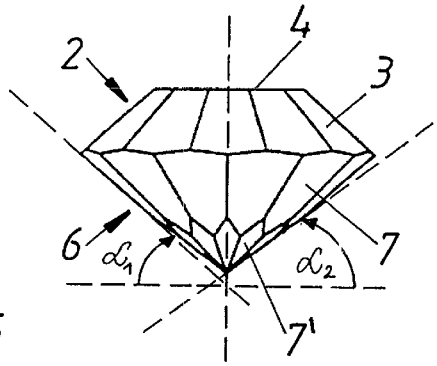
Figure 2C:
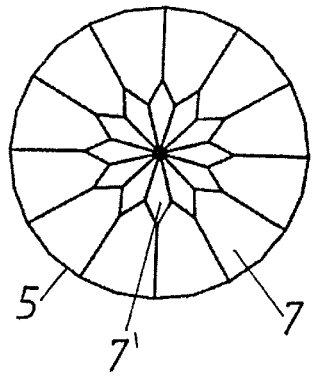
Figure 7:
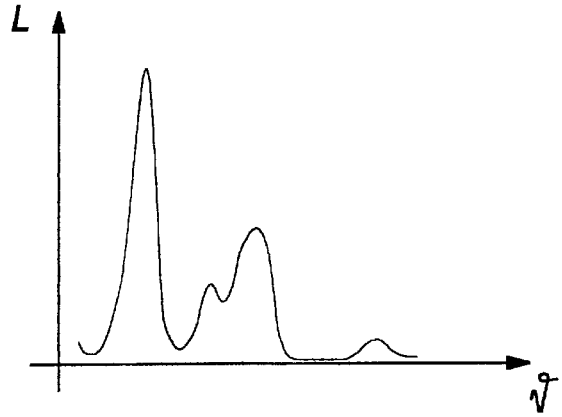

Such a gemstone in accordance with the invention, as shown in FIGS. 2*a*, 2*b* and 2*c*, affords a reflection characteristic as is shown approximately in FIG. 7. In comparison with FIG. 6, there are light components with greater theta angles. In other words, there is a distribution of light which radiates more widely.

Figure 3A:
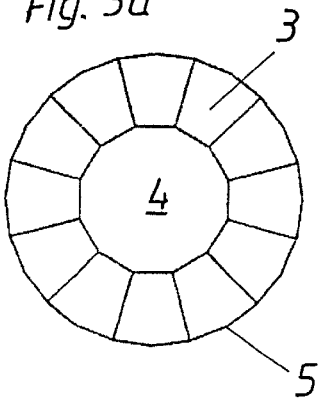
FIGS. 3*a*, 3*b* and 3*c* show a further embodiment of a gemstone according to the invention with a second pavilion layer with a grinding depth of 75%.
Figure 3B:
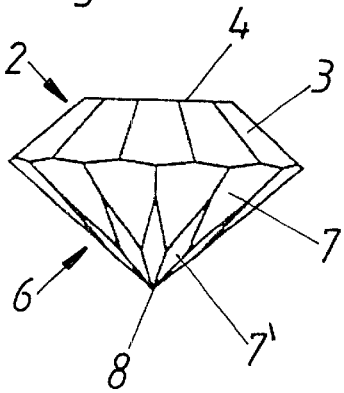
Figure 3C:
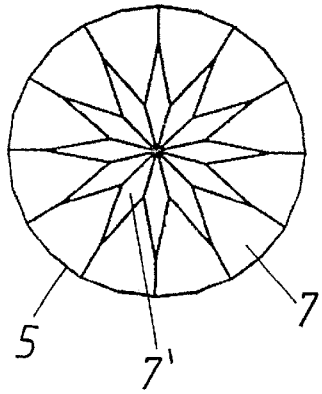
Figure 4:
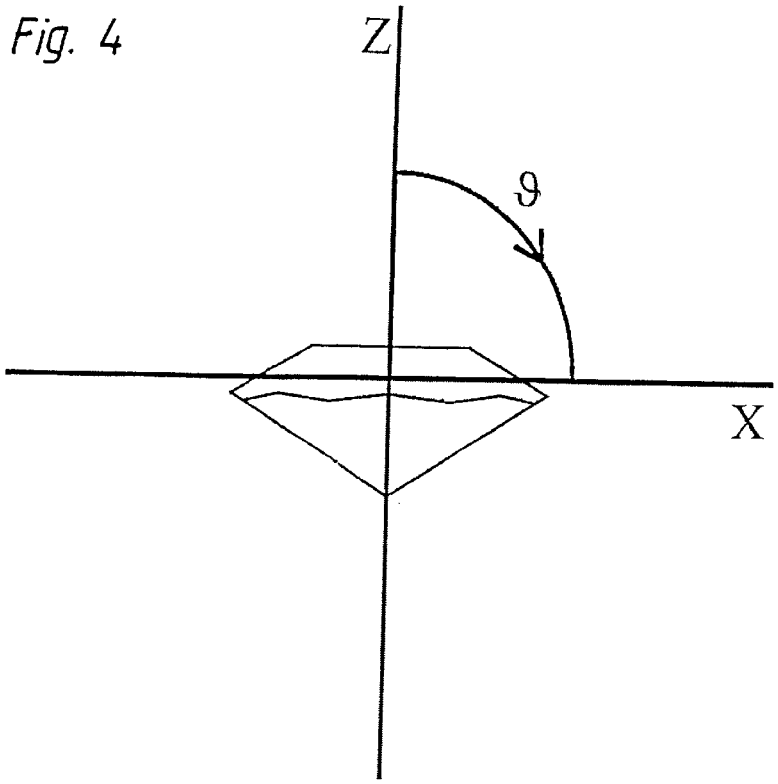
FIG. 4 shows measurement of the height angle theta.
Figure 5:
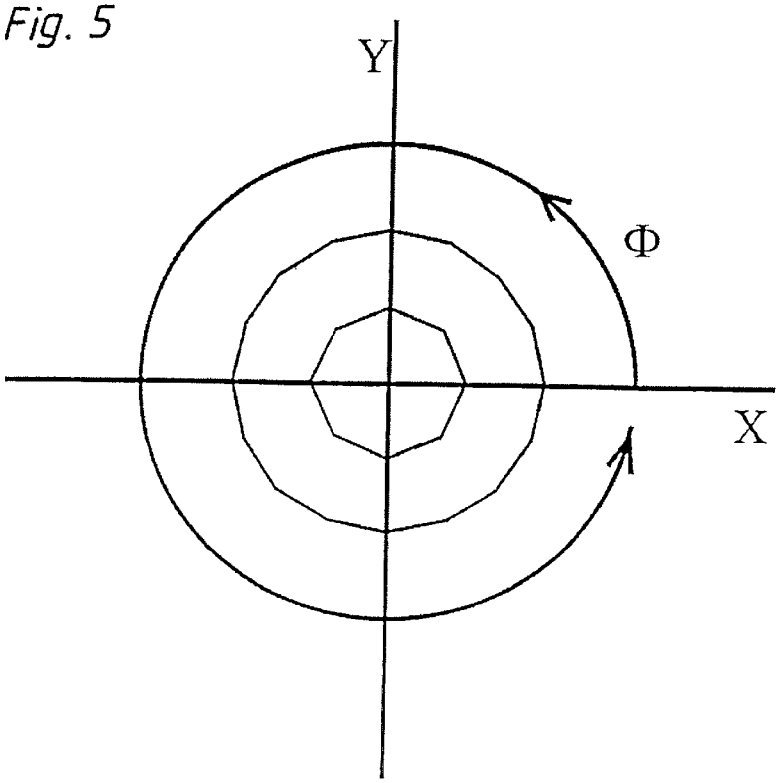
FIG. 5 shows measurement of the width angle phi.
Figure 8:
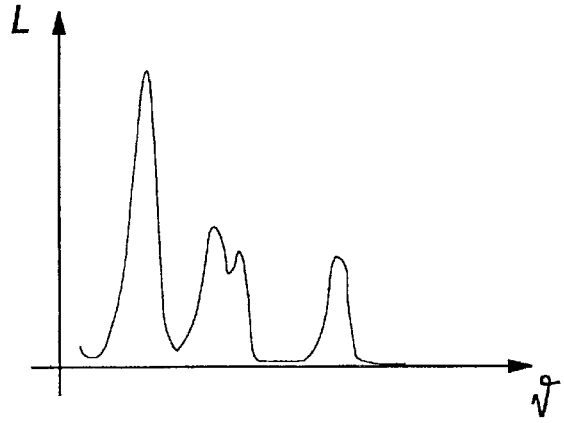

FIGS. 3*a*, 3*b* and 3*c* show an embodiment of a gemstone according to the invention with a grinding depth of 75%. That affords the light distribution approximately as shown in FIG. 8.

In accordance with a variant of the invention there is provided a gemstone in which the crown angle $\beta$ is between 40° and 44°, preferably being about 42°. The first pavilion angle $\alpha_1$ is desirably between 40° and 44°, preferably being about 42°, while the second pavilion angle $\alpha_2$ is between 32° and 36°, preferably being about 34°. With those angles, particularly in the case of a gemstone of ground glass with a refractive index of between 1.50 and 1.65, the reflection characteristic is good and radiates widely.

It will be appreciated that the invention is not limited to the embodiments illustrated by way of example. For example, the number of facets may differ. Even numbers of facets 8, 12 or 16 have proven to be preferable. In principle, however, other numbers of facets, in particular odd numbers of facets, are certainly conceivable and possible. The number of facets of the crown on the one hand and the pavilion on the other hand also do not necessarily have to be the same, although an identical number of facets in the crown of the first pavilion angle and the second pavilion angle has been found to be advantageous.

What is claimed is:

1. An artificial gemstone comprising:

a crown having facets and a flat table, each of said facets being inclined at a crown angle with respect to a central axis and extending between said flat table and a peripheral edge of the gemstone; and a pavilion having only:

a tip;

a first set of facets each extending from said peripheral edge and being inclined at a first pavilion angle with respect to said central axis; and a second set of facets each extending from said tip toward said first set of facets and being inclined at a second pavilion angle with respect to said central axis, said first pavilion angle being different than said second pavilion angle; and wherein the gemstone is formed of glass.

2. The artificial gemstone of claim 1, wherein a quantity of said facets of said crown is equal to a quantity of said first set of facets of said pavilion, and is equal to a quantity of said second set of facets of said pavilion.

3. The artificial gemstone of claim 2, wherein said quantity of said facets of said crown is 8.

4. The artificial gemstone of claim 2, wherein said quantity of said facets of said crown is 12.

5. The artificial gemstone of claim 1, wherein said second set of facets extend radially from said tip to a length of 25% to 75% of a distance between said tip and said peripheral edge when viewed facing said tip.

6. The artificial gemstone of claim 1, wherein said glass has a refractive index of 1.50 to 1.65.

7. The artificial gemstone of claim 1, wherein said second set of facets extends from said tip toward said first set of facets without reaching said peripheral edge.

8. The artificial gemstone of claim 1, wherein the gemstone is formed of ground glass.

* * * * *